United States Patent [19]

Kawaguchi et al.

[11] 3,958,439

[45] May 25, 1976

[54] METHOD FOR RECOVERING DUCTILITY OF A COLD ROLLED METAL STRIP

[75] Inventors: Kiyoshi Kawaguchi, Kudamatsu; Hiroshi Harada; Kaoru Shoge, both of Tokuyama; Kenji Ono, Kudamatsu, all of Japan

[73] Assignee: Toyo Kohan Co., Ltd., Tokyo, Japan

[22] Filed: May 28, 1974

[21] Appl. No.: 473,904

[30] Foreign Application Priority Data

May 31, 1973 Japan ..... 48-60270

[52] U.S. Cl. ..... 72/163; 72/128; 72/364; 148/12 D

[51] Int. Cl.[2] ..... B21D 1/05; B21D 31/00

[58] Field of Search ..... 72/128, 160, 161, 163, 72/364; 148/12 C, 12 D

[56] References Cited

UNITED STATES PATENTS

| | | | |
|---|---|---|---|
| 3,247,946 | 4/1966 | Klein | 148/4 |
| 3,260,093 | 7/1966 | Polakowski | 72/163 |
| 3,264,144 | 8/1966 | Frazier et al. | 148/12 D |
| 3,326,025 | 6/1967 | Nishioka | 72/161 |
| 3,513,677 | 5/1970 | Polakowski | 72/163 |
| 3,527,078 | 9/1970 | Lawson et al. | 72/163 |
| 3,537,913 | 11/1970 | Klisowski | 148/12 C |
| 3,605,470 | 9/1971 | Polakowski | 72/163 |
| 3,700,504 | 10/1972 | Roberts et al. | 148/12 D |
| 3,812,697 | 5/1974 | Kawaguchi et al. | 72/160 X |
| 3,812,701 | 5/1974 | Miyamatsu et al. | 72/163 |

*Primary Examiner*—C. W. Lanham
*Assistant Examiner*—E. M. Combs
*Attorney, Agent, or Firm*—Armstrong, Nikaido & Wegner

[57] ABSTRACT

The present invention relates to a method and apparatus of recovering ductility of a cold rolled metal strip. The metal strip is greatly bent a few times under tension along work rolls of small diameter rotating freely with extremely low friction or on fluid film of pressurized liquid in the space formed between the metal strip and a supporting guide. Thereby the stress-strain curve of the metal strip is altered, and the change results in recovering ductility of the metal strip.

3 Claims, 6 Drawing Figures

METHOD FOR RECOVERING DUCTILITY OF A COLD ROLLED METAL STRIP

BACKGROUND OF THE INVENTION

1. Field of the Invention

This invention relates to a method and apparatus for recovering ductility of a cold rolled metal strip.

In producing a metal strip, tensile strength and ductility of the metal strip are controlled by changing the reduction of rolling, and the temperature and time of heat treatment. Recently, extremely thin metal strip of high tensile strength have been produced by a double reduce method of rolling a metal strip with large reduction after annealing instead of conventional tempering.

A metal strip manufactured by this method has a high tensile strength, but ductility and workability are low because of work hardening by rolling with a large reduction. This sometimes causes breaking of the material in a can making process, particularly in the flanging process. Can making is a major field in which thin metal strips are employed. Workability in can making does not have to be as large as in deep drawing and a small increase in workability is good enough. It has been found that an increase in ductility by a small percentage in a thin metal strip helps reduce the trouble. However it is not desirable on the product and installation costs to provide an annealing process for small increases in ductility.

2. Description of the Prior Art

The patent publication of the application Nos. 41-12,292 and 47-19,856 in Japan show ductility of a cold rolled metal strip can be recovered by bending it repeatedly 50 to more than 100 times with a roller leveler. In these methods, alternate tensile and compressive strains by bending result in softening the material. These disclosures have the disadvantage that a large space is necessary to install a leveler with a number of rollers for continuous production and further, scratches arise on the surface of a metal strip because it is difficult to rotate many rollers of the roller leveler at the same speed. The metal strip passes through a curing process after printing. Therefore, the ductility of the metal strip subjectd to heat treatment even decreases due to scratches on the surface and micro fractures in the metallic crystal when shape defects of the metal strip are corrected by a leveler as mentioned in the references.

An object of the present invention is to provide a method of recovering ductility of a cold rolled metal strip using a less expensve and smaller equipment.

Another object of the invention is to provide a method of recovering ductility without causing scratching on the surface of a metal strip. Further object is to provide a method by which the effect of recovering ductility is maintained even after heat treatment.

SUMMARY OF THE INVENTION

In the present invention, a metal strip is bent strongly two or three times under tension along work rolls of small diameter rotating freely with extremely low friction or on fluid film of pressurized liquid formed between the metal strip and a supporting guide. Thereby the stress-strain curve of the metal strip after leveling is altered from that after cold rolling and the change results in recovering the ductility of the metal strip.

Relating to the apparatus by which shape defects of the metal strip are corrected in such a way that the metal strip is bent strongly a few times under tension along work rolls of small diameter or on fluid film of pressurized liquid, the patents have been already applied as patent applications of Ser. Nos. 315,108 and 329,310 in the United States, now U.S. Pat. Nos. 3,812,701 and 3,812,697, respectively.

DETAILED DESCRIPTION OF THE PREFERRED EMBODIMENTS

Figure 1:
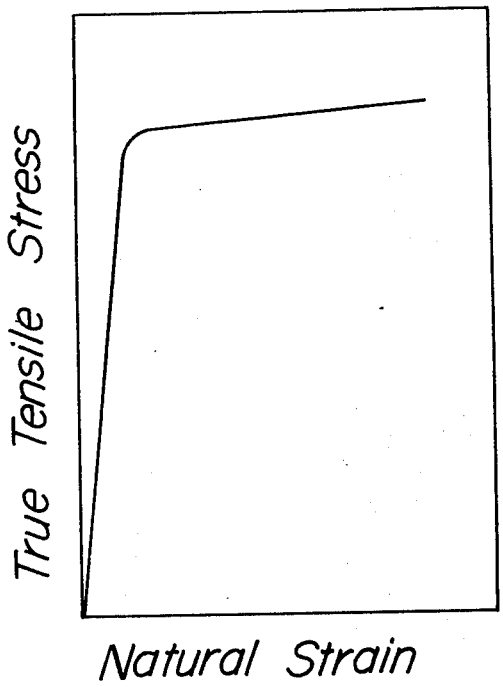
FIG. 1 is the stress-strain curve of a metal strip after cold rolling.

When a cold rolled metal strip is stretched and broken, compared with elongation at the breaking portion of the metal strip, elongation in the remaining portion is extremely small. Thus plastic strain arises concentrically at the breaking portion of the cold rolled metal strip becuase the yield stress is high and the work hardening exponent is low in a metal strip after cold rolling as shown in FIG. 1. When a metal strip having the stress-strain curve in FIG. 1 is stretched, reduction of the thickness of the metal strip by an increase in load applied to the metal strip becomes great and uniform elongation is small. Once such a necking begins to occur, the phenomena grows rapidly and the strip breaks before the remaining portion is stretched sufficiently. In repeated bendings of the metal strip a number of times by a roller leveler as mentioned above, there is an effect of changing the characterstics of a cold rolled strip, but the problem of scratching on the surface due to the number of bendings still remains.

Accordingly, in order to recover ductility of the cold rolled metal strip, it is necessary to change the stress-strain curve of the cold rolled metal strip to that favored to tension applied when the metal is employed, for instance, in can making and also not to cause any scratching during the operation of recovering the ductility. One of the solutions is to employ work rolls of smaller diameter than of the conventional roller leveler and repeatedly bend the metal strip reversely a few times along the work rolls which rotate freely with extremely low friction.

Referring to the drawings, embodiments of the present method are explained below.

Figure 2:
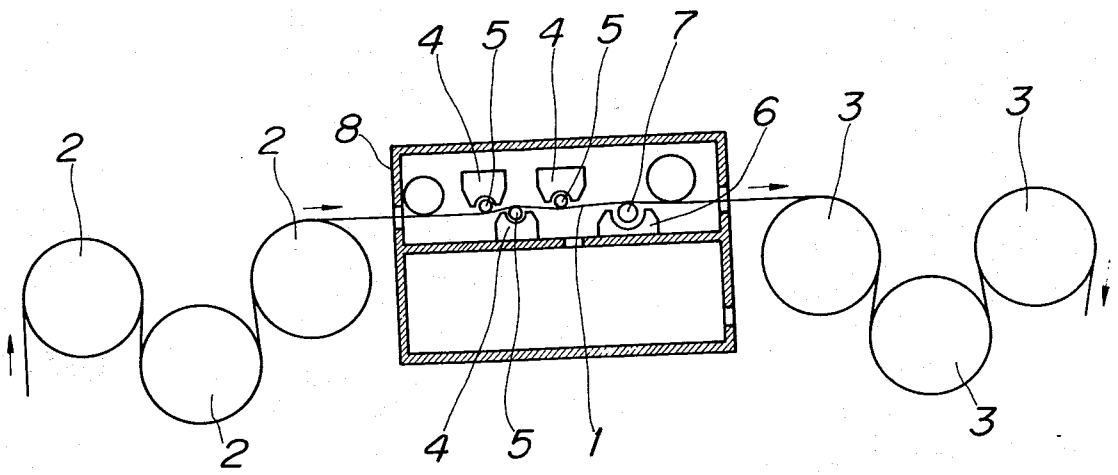
FIG. 2 shows an embodiment of the present invention.

FIG. 2 illustrates one of the embodiments of the present invention. A metal strip 1 passes through a leveling unit 8, being stretched by known tension adding devices 2 and 3 such as bridle rolls. The leveling unit 8 includes the work rolls 5 and 7 of small diameter which are supported on a film of pressurized liquid supplied from an outside pressure source and float on roll supporting guides 4 and 6 are disclosed in the U.S. patent application, Ser. No. 315,108, now U.S. Pat. No. 3,812,701. In FIG. 2, disposition of the work rolls and other supplemental rolls is only illustrated and mechanisms of positioning the roll supporting guide 4 and 6 are not described. The cold rolled metal strip 1 is bent with an extremely small radius curvature during passage through the leveling unit 8, therefore the stress-strain curve of the metal strip changes to that in FIG. 3 after repeated bending.

Figure 3:
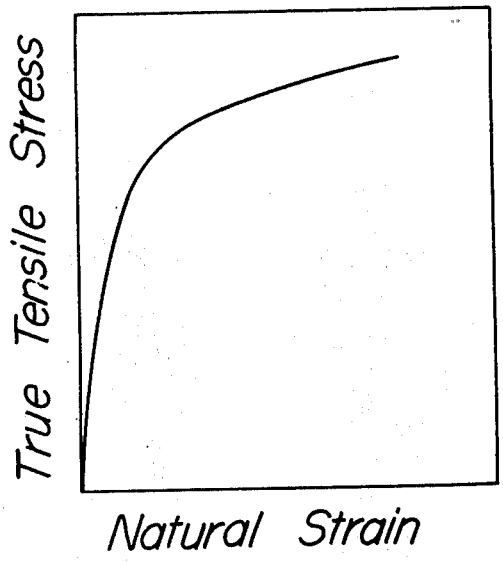
FIG. 3 is the stress-strain curve of metal strip using the present invention.

Scratches do not show up and an excellent surface on the metal strip is maintained because the work rolls 5 and 7 are not driven and rotate freely on the film of pressurized liquid with extremely low friction. Thus no slippage arises between the metal strip 1 and the work roll 5 or 7. When the metal strip having the stress-strain curve in FIG. 3 is stretched, uniform elongation becomes greater than that of the metal strip as cold rolled and total elongation from necking to breaking also becomes greater.

Accordingly, in the present invention, the change of the stress-strain curve of cold rolled metal strip results in recovering ductility of the material by enabling to elongate the metal strip as a whole.

Figure 4:
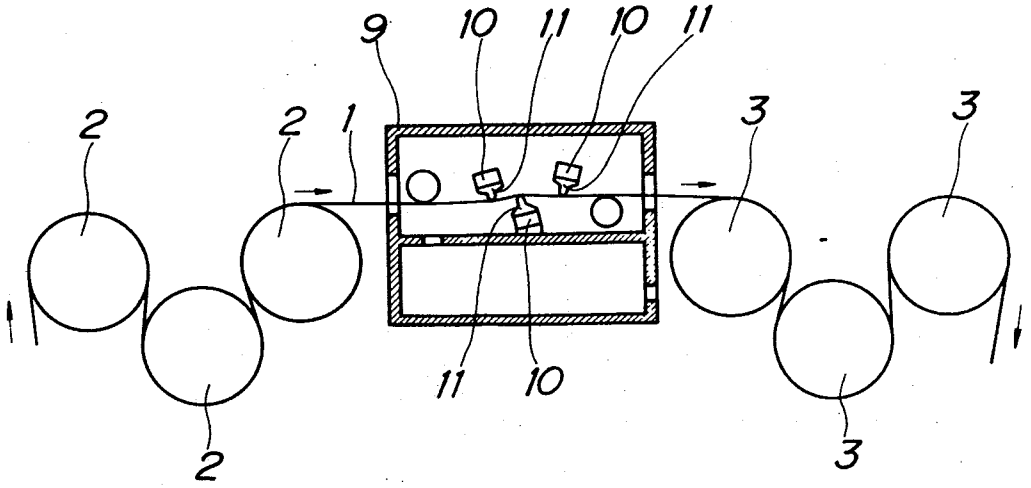
FIG. 4 is another embodiment by the present invention.

FIG. 4 illustrates another embodiment of the invention. In this case, the cold rolled metal strip 1 passes through a leveling unit 9, being stretched by the front and back bridle rolls 2 and 3. The leveler unit 9 the patent application of Ser. No. 329,310 of which was applied in the United States, now U.S. Pat. No. 3,812,697, involves supporting bases 10 and supporting guides 11 through which pressurized liquid is supplied to the space formed between the metal strip 1 and supporting guide 11. Only disposition of the supporting base 10 and the supporting guides 11 is illustrated and mechanisms for positioning these parts is not shown in the figure. The cold rolled metal strip 1 is bent with an extremely small radius of curvature during passage through the leveling unit 9, being supported by pressurized liquid and out of contact with the supporting guide 11. In this case, the stress-strain curve of the metal strip is shown in FIG. 3, therefore ductility of the metal strip recovers in the same reason as mentioned before.

When the present invention is applied, the metal strip elongates plastically in the advancing direction mainly. Reduction of thickness is around 1% and thus insignificant.

Figure 5:
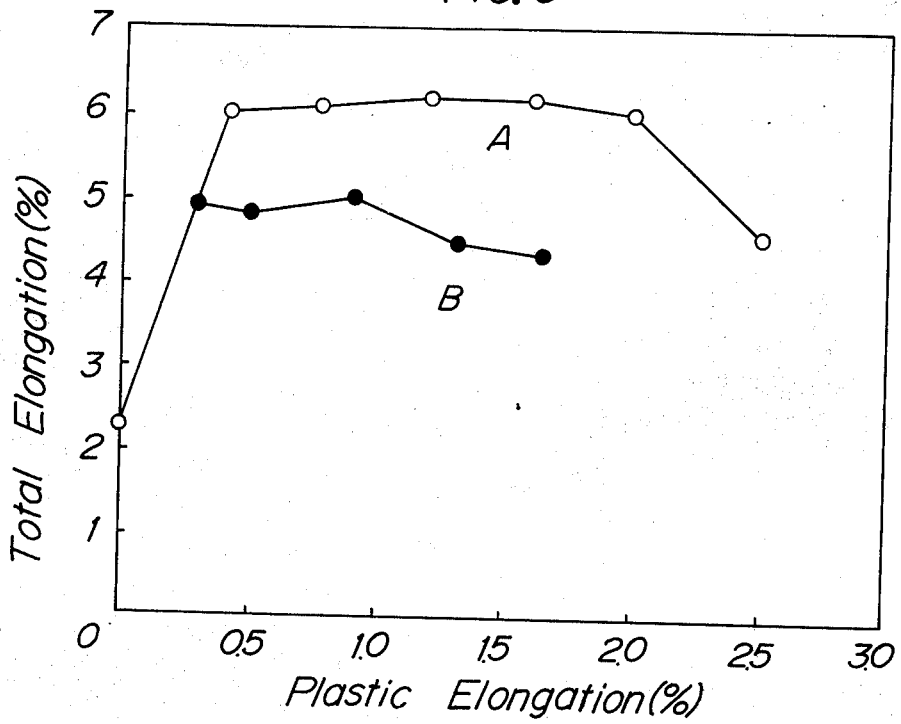
FIG. 5 shows the effect of recovering ductility of a metal strip using the present invention.

FIG. 5 shows the relationship between plastic elongation by the present method of a cold rolled steel strip with reduction of 25% and total elongation of the same metal strip. In the range of plastic elongation of 0.3 to 2%, the maximum recovery of ductility is obtained. Then the tensile strength is 55 kg/mm².

Figure 6:
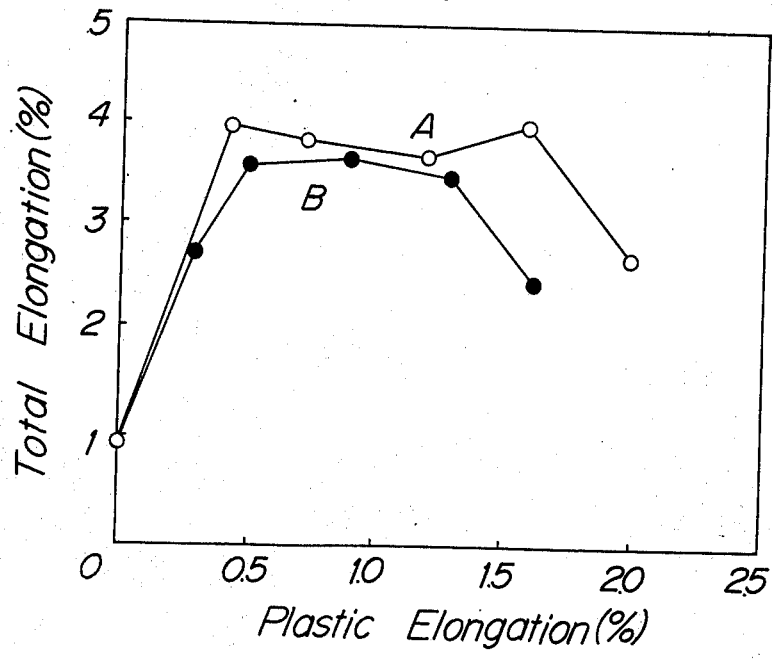
FIG. 6 shows the effect of recovering ductility of a metal strip when aging is applied.

FIG. 6 shows the relationship between plastic elongation by the present method of a cold rolled steel strip with 25% reduction and the total elongation when aging is applied to the metal strip for 30 minutes at 243°C after recovering ductility. When plastic elongation is zero, the total elongation becomes less and the tensile strength is 56 kg/mm² and higher than before aging treatment. On the other hand, when the steel strip is elongated plastically by the present method, ductility does not deteriorate extremely. Lines A and B in the figure correspond with bending radius of 2.5 mm and 7.5 mm respectively. Relating the effect of bending radius to recovering ductility in the present invention, the less the bending radius is, the more the effect of recovering ductility is. After aging treatment, the less the bending radius is, the wider the range of plastic elongation to enable recovery of ductility. Therefore in the present invention, a small as possible bending radius is preferred and it is necessary for the ratio of bending radius of a metal strip to its thickness to be less than 50 to obtain a sufficient effect.

Table 1 shows a result of testing cold rolled steel strip with various reductions by the present method. The present method is very effective for steel strip with more than 15% reduction. In Table 1, total elongation 1 is that of steel strip as cold rolled, total elongation 2 is that of steel strip treated by the present invention, total elongation 3 is that of steel strip which aging is applied to in 30 minutes at 243°C after processed by the present invention and the tensile strength 3 is that of the steel strip. Total elongations and tensile strength in Table 1 are all those in the rolling direction. In the present invention, decrease of friction by the effect of forced lubrication, removal of substances on the metal strip surface by large amount of fluid and bending only a few times help to significantly reduce scratches on the metal surface. Therefore ductility of a cold rolled metal strip does not reduce after recovered even though it is processed with aging in the succeeding stage, while the tensile strength increases.

TABLE 1

| reduction % | thickness mm | tensile strength kg/mm² | total elongation 1 % | total elongation 2 % | total elongation 3 % | tensile strength 3 kg/mm² |
|---|---|---|---|---|---|---|
| 15 | 0.187 | 46.5 | 10.8 | 14.8 | 12.5 | 47.0 |
| 25 | 0.168 | 55.0 | 2.4 | 6.3 | 4.0 | 56.0 |
| 27 | 0.160 | 56.0 | 3.0 | 6.5 | 5.5 | 56.0 |
| 37 | 0.270 | 69.5 | 1.2 | 2.8 | 2.0 | 70.0 |
| 40 | 0.185 | 90.0 | 2.0 | 5.0 | 3.0 | 92.0 |

What is claimed is:

1. A method of recovering ductility of a cold rolled, annealed metal strip which has been cold rolled with more than 15% reduction after annealing, said method comprising:

a. applying tension to said metal strip, thereby plastically elongating it; and b. bending said strip while under said tension a plurality of times, the ratio of the radius of curvature of the bends to the thickness of the strip being less than 50:1.

2. A method claimed in claim 1, wherein bending said strip comprises supporting said strip on work rolls which contact said strip, each work roll being supported on a film of pressurized liquid.

3. A method claimed in claim 1, wherein bending said comprises supporting said strip on a film of pressurized liquid in a clearance formed between said metal strip and a support guide.

* * * * *